US011844439B1

(12) United States Patent
Wang

(10) Patent No.: US 11,844,439 B1
(45) Date of Patent: Dec. 19, 2023

(54) HEIGHT-ADJUSTABLE FOLDING CHAIR

(71) Applicant: Shenzhen Chuangboyou Technology Development Co., LTD, Shenzhen (CN)

(72) Inventor: Lili Wang, Shenzhen (CN)

( * ) Notice: Subject to any disclaimer, the term of this patent is extended or adjusted under 35 U.S.C. 154(b) by 0 days.

(21) Appl. No.: 18/176,278

(22) Filed: Feb. 28, 2023

(30) Foreign Application Priority Data

Jan. 13, 2023 (CN) ..... 202320148374.2

(51) Int. Cl.
*A47C 4/28* (2006.01)
*A47C 3/40* (2006.01)

(52) U.S. Cl.
CPC ..... *A47C 4/286* (2013.01); *A47C 3/40* (2013.01)

(58) Field of Classification Search
None
See application file for complete search history.

(56) References Cited

U.S. PATENT DOCUMENTS 4,317,552 A * 3/1982 Weidler ..... F16M 13/00 248/168
5,263,506 A * 11/1993 Narramore ..... A61H 3/00 135/74
5,531,502 A * 7/1996 Berggren ..... A47D 1/08 297/131
10,010,179 B1 * 7/2018 Stump ..... A47C 4/44
10,688,013 B2 * 6/2020 Joles ..... A61H 3/00
11,439,238 B1 * 9/2022 Wang ..... A47C 4/286
2008/0164740 A1 * 7/2008 Harper ..... B60N 2/2209 297/331
2010/0181806 A1 * 7/2010 Hu ..... A47D 1/023 297/16.1
2015/0233522 A1 * 8/2015 Kallas ..... F16M 11/2021 403/322.2
2017/0090352 A1 * 3/2017 Miyakoshi ..... G03G 21/168
2017/0188709 A1 * 7/2017 Bergling ..... A47C 4/286
2019/0183241 A1 * 6/2019 Baker ..... A47B 17/06
2021/0009219 A1 * 1/2021 Zarrouk ..... B62D 57/028
2021/0309128 A1 * 10/2021 Jung ..... B60N 2/1825
2023/0172358 A1 * 6/2023 Xu ..... A47C 9/105 297/16.2

FOREIGN PATENT DOCUMENTS

DE 102006051181 A1 * 5/2007 ..... A47B 9/16

* cited by examiner

*Primary Examiner* — David E Allred

(57) ABSTRACT

The present disclosure proposes a height-adjustable folding chair including a base, retractable arms connected to the base and legs connected to the base; the base includes a support enclosing an inner cavity and a locking assembly arranged in the inner cavity; the support includes an upper receiving portion connected to the arms and a lower receiving portion connected to the legs; the locking assembly includes a leg unlock button inserted in the inner cavity and slidable relative to the support, a first spring, and a first locking block. The first locking block defines locking slots each with a downward opening; an end of each leg connected to the lower receiving portion defines a positioning slot and is arranged with a positioning tongue protruding from an edge of the positioning slot and a positioning block protruding upward from a bottom of the positioning slot and matched with a corresponding locking slot.

12 Claims, 9 Drawing Sheets

HEIGHT-ADJUSTABLE FOLDING CHAIR

CROSS REFERENCE

The present application claims foreign priority of Chinese Patent Application No. 202320148374.2, filed on Jan. 13, 2023, in the China National Intellectual Property Administration, the entire contents of which are hereby incorporated by reference in its entirety.

TECHNICAL FIELD

The present disclosure relates to the field of seating technologies, in particular, relates to a height-adjustable folding chair.

BACKGROUND

Folding chair is a common chair in daily life, which can usually be retracted and reduced for storage and handling.

At present, there are many different styles of folding chairs on the market, but these folding chairs have only two stable states: a fully unfolded state and a fully retracted state. Conventionally, when the folding chair is unfolded, the height of the folding chair and the width of the chair surface is fixed, which cannot adapt to different needs of users.

SUMMARY OF THE DISCLOSURE

Based on this, it is necessary to propose a height-adjustable folding chair which can be conveniently operated.

The present disclosure provides a height-adjustable folding chair, including a base, a plurality of retractable arms connected to the base, and a plurality of legs connected to the base; wherein the base includes a support enclosing an inner cavity and a locking assembly arranged in the inner cavity; the support includes an upper receiving portion connected to the plurality of retractable arms and a lower receiving portion connected to the plurality of legs; the locking assembly includes a leg unlock button inserted in the inner cavity and slidable relative to the support, a first spring arranged in the leg unlock button, and a first locking block connected to the leg unlock button; the first locking block defines a plurality of locking slots each with a downward opening; an end of each leg connected to the lower receiving portion defines a positioning slot and is arranged with a positioning tongue protruding from an edge of the positioning slot and a positioning block protruding upward from a bottom of the positioning slot and matched with a corresponding locking slot; the positioning tongue abuts against an outer wall of the first locking block in condition of the leg being unfolded to a first unfolded state relative to the base; and the positioning tongue abuts against an inner wall of the corresponding locking slot in condition of the leg being unfolded to a second unfolded state relative to the base.

In some embodiments, an end of each leg away from the base is arranged on a support surface; a distance from the base to the support surface in the first unfolded state is greater than a distance from the base to the support surface in the second unfolded state.

In some embodiments, the end of each leg connected to the lower receiving portion is arranged with a plurality of leg tooth portions, and the plurality of leg tooth portions of the plurality of legs are engaged such that a motion of each leg is capable of causing the rest of the plurality of legs to move.

In some embodiments, the end of each leg connected to the lower receiving portion is further arranged with a leg arc, and the plurality of leg tooth portions are distributed on both sides of the leg arc; each tooth of the plurality of leg tooth portions is elliptically chamfered.

In some embodiments, the upper receiving portion is arranged with a stop to limit a downward rotation angle of the plurality of retractable arms.

In some embodiments, the locking assembly further includes an arm unlock button inserted in the inner cavity and slidable relative to the support, a second spring sleeved in the arm unlock button, and a second locking block connected to the arm unlock button; an end of each retractable arm connected to the upper receiving portion defines an arm positioning slot; the second locking block is stuck in the arm positioning slot and is positioned by an elasticity of the second spring in condition of the retractable arm being unfolded related to the base.

In some embodiments, each leg defines a receiving slot; in condition of the folding chair being retracted, each retractable arm is housed in a corresponding leg.

In some embodiments, the upper receiving portion is arranged with a motion stop to limit an upward rotation angle of the plurality of arms.

In some embodiments, each arm includes a front arm and a rear arm, with a maximum length of the front arm being less than a maximum length of the rear arm.

In some embodiments, the motion stop includes a front stop and a rear stop, with the front stop limiting an angle at which the front arm rotates being less than the rear stop limiting an angle at which the rear arm rotates.

The height-adjustable folding chair provided by the present disclosure includes a base, multiple retractable arms connected to the base and multiple legs connected to the base; the base includes a support enclosing an inner cavity and a locking assembly arranged in the inner cavity; the support includes an upper receiving portion connected to the arms and a lower receiving portion connected to the legs; the locking assembly includes a leg unlock button inserted in the inner cavity and slidable relative to the support, a first spring arranged in the leg unlock button, and a first locking block connected to the leg unlock button. The first locking block defines locking slots each with a downward opening; an end of each leg connected to the lower receiving portion defines a positioning slot and is arranged with a positioning tongue protruding from an edge of the positioning slot and a positioning block protruding upward from a bottom of the positioning slot and matched with a corresponding locking slot. The positioning tongue abuts against an outer wall of the first locking block when the legs are unfolded to a first unfolded state relative to the base; and the positioning tongue abuts against the inner wall of the locking slot when the legs are unfolded to a second unfolded state relative to the base. By virtue of the locking slot of the first locking block cooperating with the positioning slot, the positioning tongue, and the positioning block of the leg, the folding chair can have two different unfolding states, thereby improving the use experience.

BRIEF DESCRIPTION OF THE DRAWINGS

In order to more clearly illustrate the technical solutions in the specific embodiments of the present disclosure or the related art, the following will briefly introduce the accompanying drawings that need to be used in the specific embodiments or related art. It is obvious that the attached drawings in the following description are some of the embodiments of the present disclosure. For those skilled in the art, other accompanying drawings may be obtained from these drawings without creative effort.

DETAILED DESCRIPTION

Figure 1:
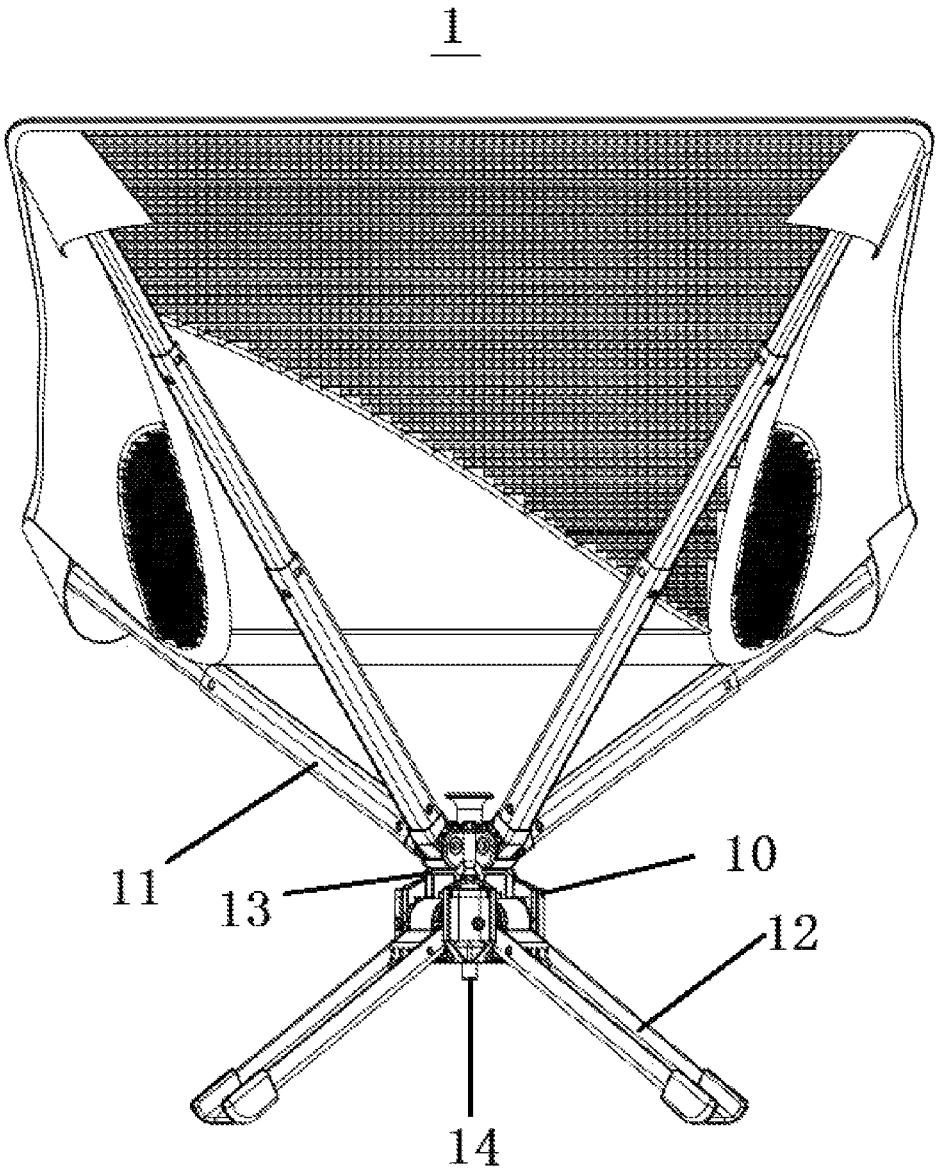
FIG. 1 is an assembled schematic view of a height-adjustable folding chair according to an embodiment of the present disclosure.
Figure 2:
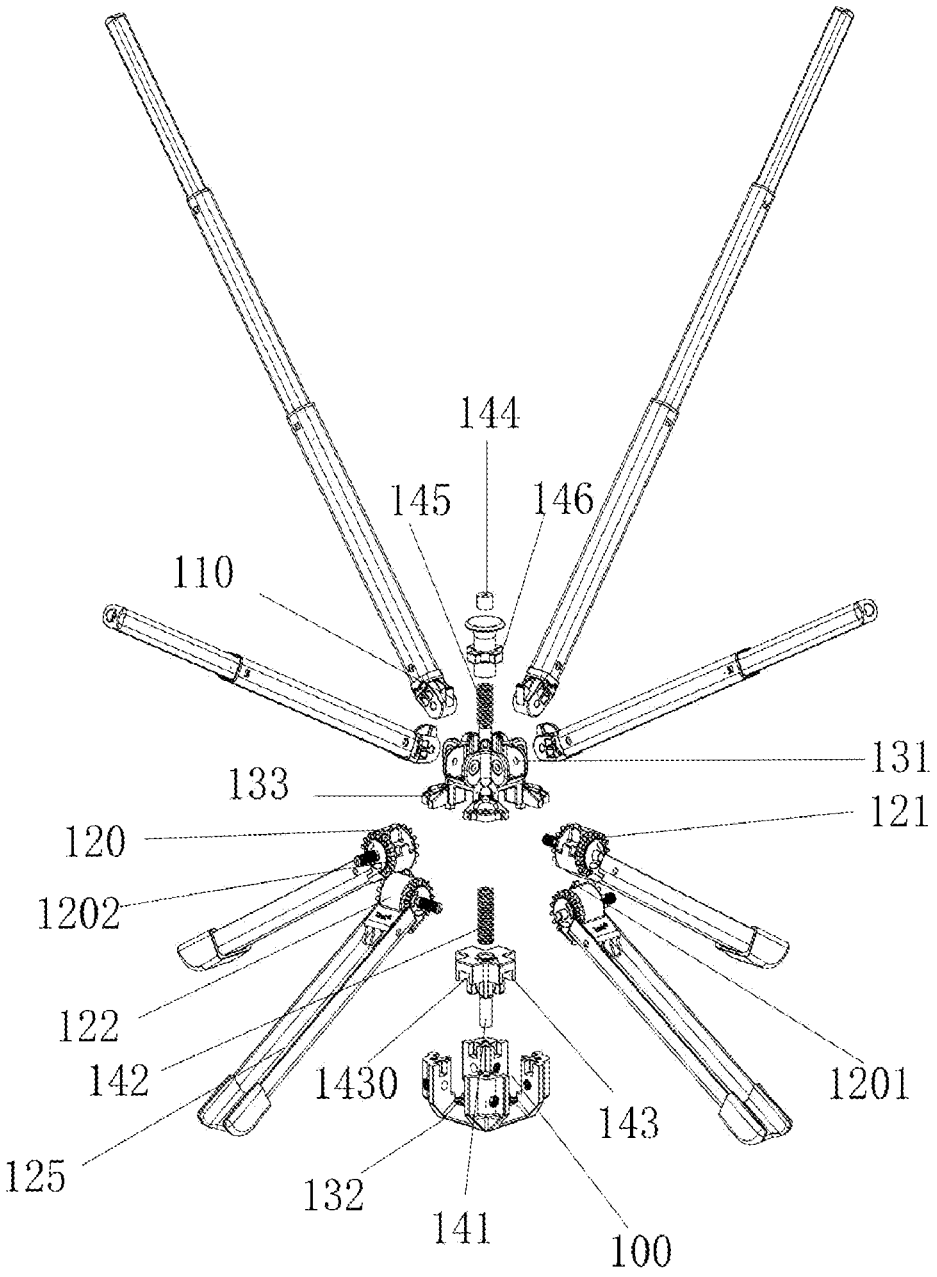
FIG. 2 is an exploded schematic view of a height-adjustable folding chair according to an embodiment of the present disclosure.

The following will be a clear and complete description of the technical solution of the present disclosure in conjunction with the accompanying drawings. Obviously, the described embodiments are part of the embodiments of the present disclosure, not all of them. Based on the embodiments in the present disclosure, all other embodiments obtained by those skilled in the art without making creative labor belong to the scope of the present disclosure.

In the description of the present disclosure, it should be noted that if terms "center", "upper", "lower", "left", "right", "vertical", "horizontal", "inside", "outside", etc. are used, the orientation or position relationship indicated therein is based on the orientation or position relationship shown in the accompanying drawings and is only for the purpose of facilitating and simplifying the description of the present disclosure, not to indicate or imply that the device or component referred to must have a specific orientation, be constructed and operated in a specific orientation, and therefore cannot be construed as a limitation of the present disclosure. In addition, the terms "first", "second", and "third" are used for descriptive purposes only, and are not to be construed as indicating or implying relative importance.

Referring to FIGS. 1-5, the present disclosure provides a height-adjustable folding chair 1 including a base 10, multiple retractable arms 11 connected to the base 10, and multiple legs 12 connected to the base 10. An end of each leg 12 away from the base 10 is arranged on a support surface to support the folding chair 1.

The base 10 includes a support 13 enclosing an inner cavity 100 and a locking assembly 14 arranged in the inner cavity 100. The support 13 includes an upper receiving portion 131 connected to the multiple retractable arms 11 and a lower receiving portion 132 connected to the multiple legs 12. The locking assembly 14 includes a leg unlock button 141 inserted in the inner cavity 100 and slidable relative to the support 13, a first spring 142 sleeved in the leg unlock button 141, and a first locking block 143 connected to the leg unlock button 141.

The first locking block 143 defines multiple locking slots 1430 each with a downward opening. An end of each leg 12 connected to the lower receiving portion 132 defines a positioning slot 120 and is arranged with a positioning tongue 1201 protruding from an edge of the positioning slot 120 and a positioning block 1202 protruding upward from a bottom of the positioning slot 120 and matched with a corresponding locking slot 1430.

Further, the end of each leg 12 connected to the lower receiving portion 132 is arranged with leg tooth portions 121, and the leg tooth portions 121 of the multiple legs 12 engage such that a motion of each leg 12 can cause the rest legs 12 to move. The end of each leg 12 connected to the lower receiving portion 132 is further arranged with a leg arc 122, and the leg tooth portions 121 are distributed on both sides of the leg arc 122. Each tooth of the leg tooth portions 121 is elliptically chamfered. The leg tooth portions 121 of the multiple legs 12 are engaged to realize the linkage of the multiple legs, thereby simplifying the operation steps of the folding chair.

Figure 5:
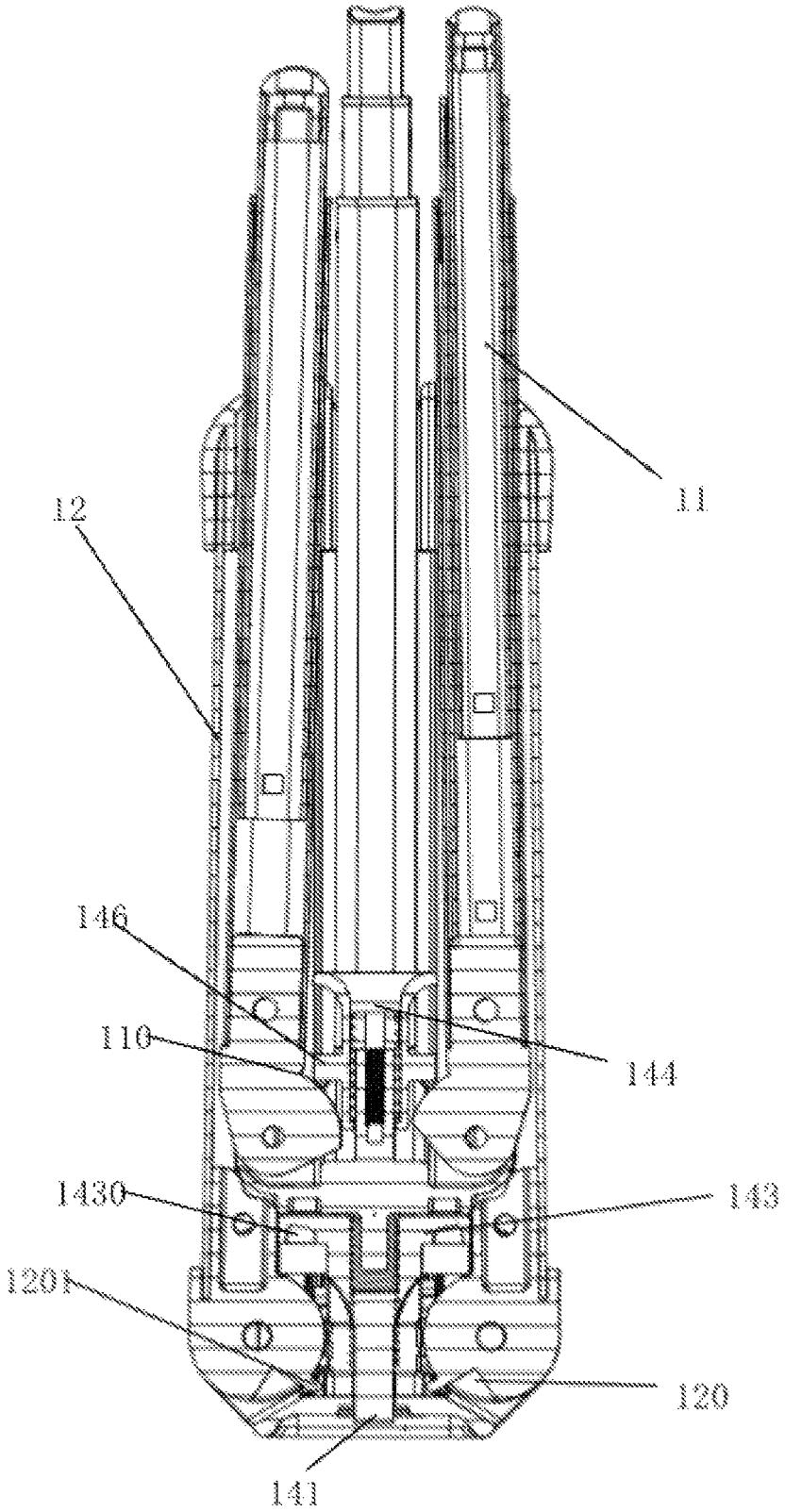
FIG. 5 is a cross-sectional view of a retracted state of a height-adjustable folding chair according to an embodiment of the present disclosure.
Figure 6:
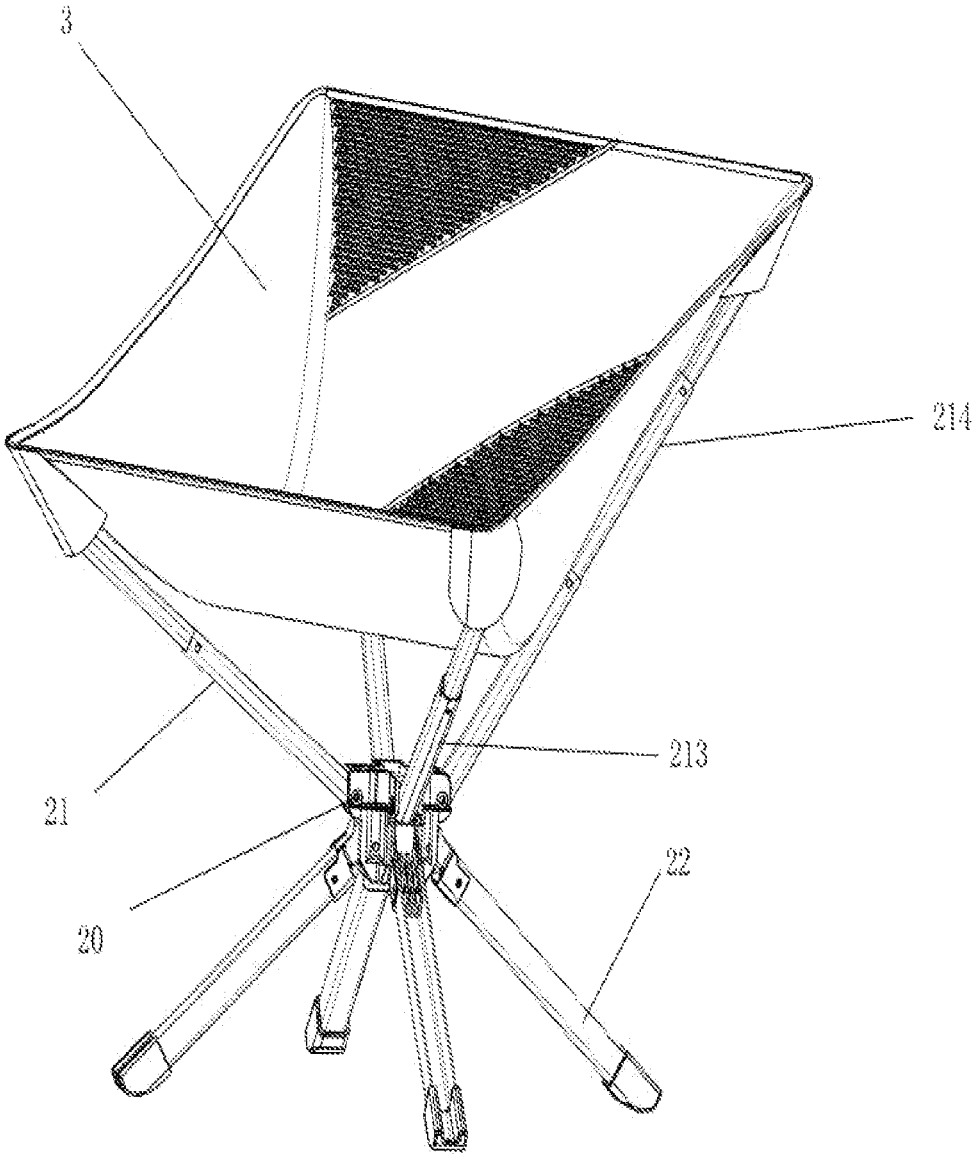
FIG. 6 is an assembled schematic view of a height-adjustable folding chair according to another embodiment of the present disclosure.

When the folding chair 1 is in a retracted state (as shown in FIG. 5), all the legs 12 and arms 11 extend toward a top of the base 10, with the positioning slots 120 of the legs 12 facing downward. When the folding chair 1 is required to be unfolded, the legs 12 may be separated directly by hand such that each leg 12 rotates downward with a center axis of the circular arc 122. All the legs 12 will rotate downward together. The first locking block 143 moves downward, and the leg unlock button 141 is pushed by the first spring 142 while moving downward to protrude from the lower receiving portion 132.

Figure 4:
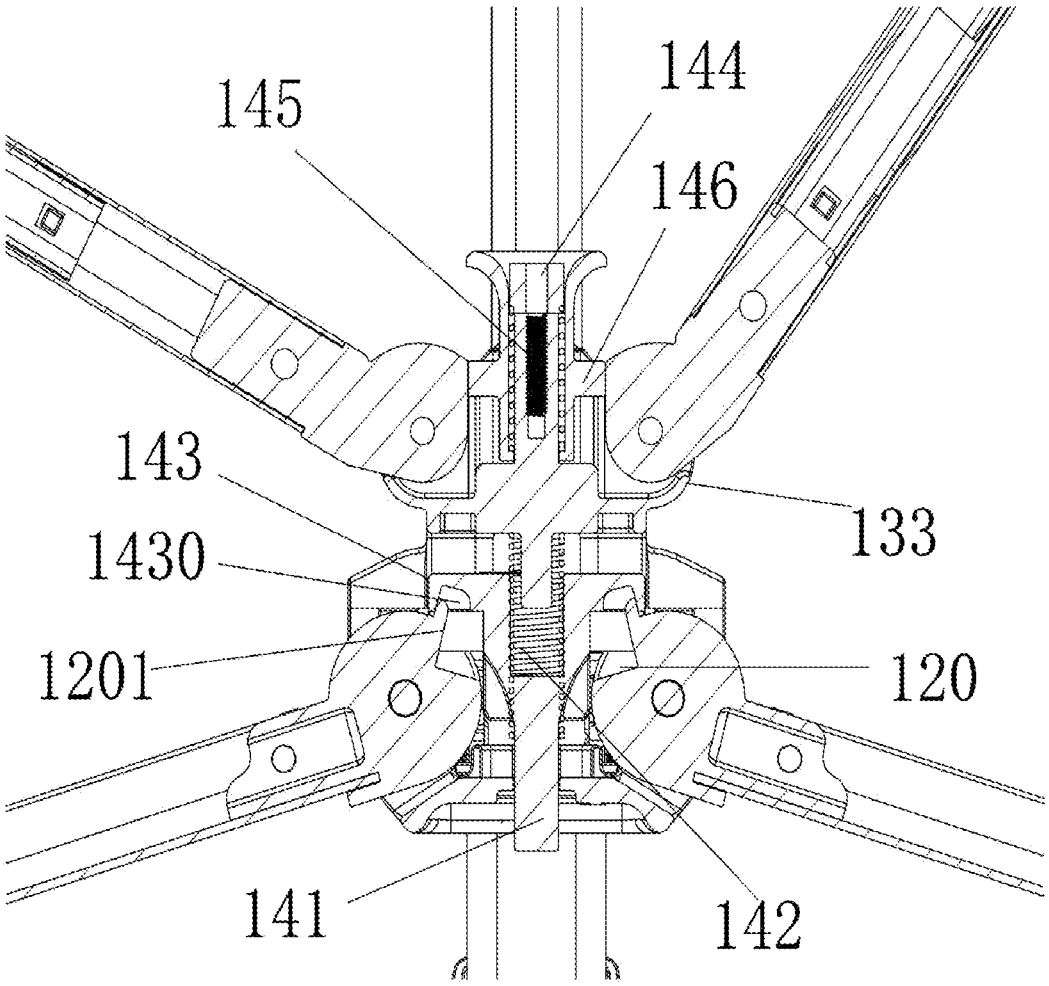
FIG. 4 is a partial cross-sectional view of a second unfolded state of a height-adjustable folding chair according to an embodiment of the present disclosure.

When the legs 12 rotate to the position shown in FIG. 4, the positioning slots 120 rotate to a position facing upward, and each positioning block 1202 enters a corresponding locking slot 1430, while the corresponding positioning tongue 1201 snaps into an inner wall of the locking slot 1430. The legs 12 are positioned in this case and will not continue to rotate, being in a second unfolded state with the height of the base 10 from the ground lower.

Figure 3:
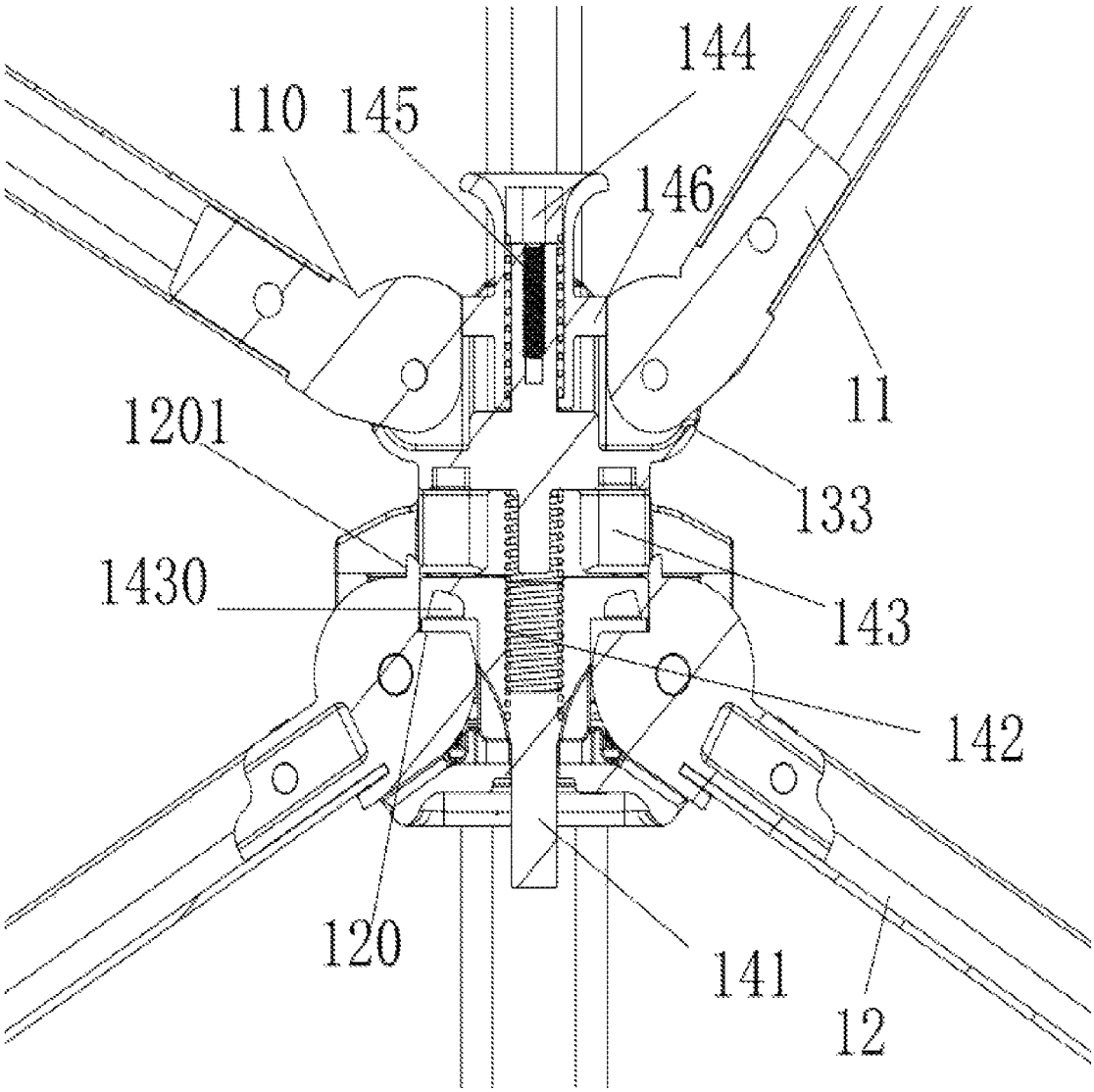
FIG. 3 is a partial cross-sectional view of a first unfolded state of a height-adjustable folding chair according to an embodiment of the present disclosure.

When the folding chair 1 is required to be adjusted higher, the leg unlock button 141 may be pressed to move the first locking block 143 upward, such that the positioning tongue 1201 and positioning block 1202 are free from the locking slot 1430, and then the legs 12 can continue to rotate downward to the position as shown in FIG. 3. In this case, the leg unlock button 141 is pushed by the first spring 142 while moving downward to further protrude from the lower receiving portion 132, the positioning tongue 1201 is stuck to an outer wall of the first locking block 143, and the circular arc 122 abuts against the support 13. In this way, the legs 12 are positioned, and the folding chair 1 is in a first unfolded state with the height of the base 10 from the ground greater than the height of the base 10 from the ground in the second unfolded state.

When the height of the folding chair 1 is required to be lowered, the leg unlock button 141 may be pressed to cause the legs 12 to rotate upward, driving each positioning block 1202 out of the locking slot 1430 downward and driving the positioning tongue 1201 to move toward the inner cavity 100 into the locking slot 1430. In this case, when the pressing action is stopped, under the elasticity of the first spring 142, the positioning tongue 1201 abuts against the inner wall of the locking slot 1430, and the folding chair 1 can also be in a stable state.

When the folding chair 1 is required to be retracted, the leg unlock button 141 may be pressed such that the legs 12 are rotated to a retracted state under an un-positioning condition.

Since the folding chair 1 can have two different unfolded states with the heights of the folding chair 1 different, which makes it easy for users to adjust the seat height according to their needs and improves the experience of use.

In some embodiments, the upper receiving portion 131 is arranged with a stop 133 to limit a downward rotation angle of the arms 11, ensuring that the arms 11 do not continue to rotate to fold downward after rotating downward with the base 10 as a circle center. The locking assembly 14 may further include an arm unlock button 144 inserted in the inner cavity 100 and slidable relative to the support 13, a second spring 145 sleeved in the arm unlock button 144, and a second locking block 146 connected to the arm unlock button 144. An end of each arm 11 connected to the upper receiving portion 121 defines an arm positioning slot 11. When the arms 11 are required to be unfolded, the arms 11 are rotated downward by directly separating them by hand, the second locking block 146 moves upward, and the arm unlock button 144 is pushed by the second spring 145 while moving upward to protrude from the upper receiving portion 131. When the arm 11 is rotated until the second locking block 146 snaps into the arm positioning slot 110, the arm 11 is positioned, and because the upper receiving portion 131 is arranged with the stop 133 to limit the rotation angle of the arm 11, the arm 11 cannot continue to rotate and the arms 11 are completely unfolded, such that the arms 11 are completely unfolded. When the arms 11 are required to be retracted, the second locking block 146 is separated from the arm positioning slot 110 by pressing the arm unlock button 144, and the arms can be rotated to the retracted state.

In some embodiments, each leg 12 defines a receiving slot 125. When the folding chair is retracted, each arm 11 is housed in each corresponding leg 12, thereby effectively reducing the volume of the folding chair 1 in the retracted state.

It can be understood that the end of each arm 11 connected to the upper receiving portion 131 may be arranged with arm tooth portions, such that a motion of each arm 11 can cause the rest arms 11 to move. The use of similar design to the legs 12 enables the unfolding angle of the arms 11 to be adjusted.

Referring to FIGS. 6-9, in other embodiments, the height-adjustable folding chair 2 includes a base 20, multiple retractable arms 21 connected to the base 20, and multiple legs 22 connected to the base 20. The base 20 includes a support 23 enclosing an inner cavity 200 and a locking assembly 24 arranged in the inner cavity 200. The support 23 includes an upper receiving portion 231 connected to the arms 21 and a lower receiving portion 232 connected to the legs 22. The locking assembly 24 includes a leg unlock button 241 inserted in the inner cavity 200 and slidable relative to the support 23, a first spring 242 connected to the leg unlock button 241, and a first locking block 243 connected to the leg unlock button 241. The first locking block 243 defines multiple locking slots 2430 each with a downward opening. An end of each leg 22 connected to the lower receiving portion 232 defines a positioning slot 220 and is arranged with a positioning tongue 2201 protruding from an edge of the positioning slot 220 and a positioning block 2202 protruding upward from a bottom of the positioning slot 220 and matched with a corresponding locking slot 2430. When the legs 22 are unfolded to a first unfolded state relative to the base 20, the positioning tongue 2201 abuts against an outer wall of the first locking block 243. When the legs 22 are unfolded to a second unfolded state relative to the base 20, the positioning tongue 2201 abuts against an inner wall of the locking slot. By virtue of the locking slot of the first locking block cooperating with the positioning slot, the positioning tongue, and the positioning block of the leg, the folding chair can have two different unfolding states, thereby improving the use experience.

Figure 9:
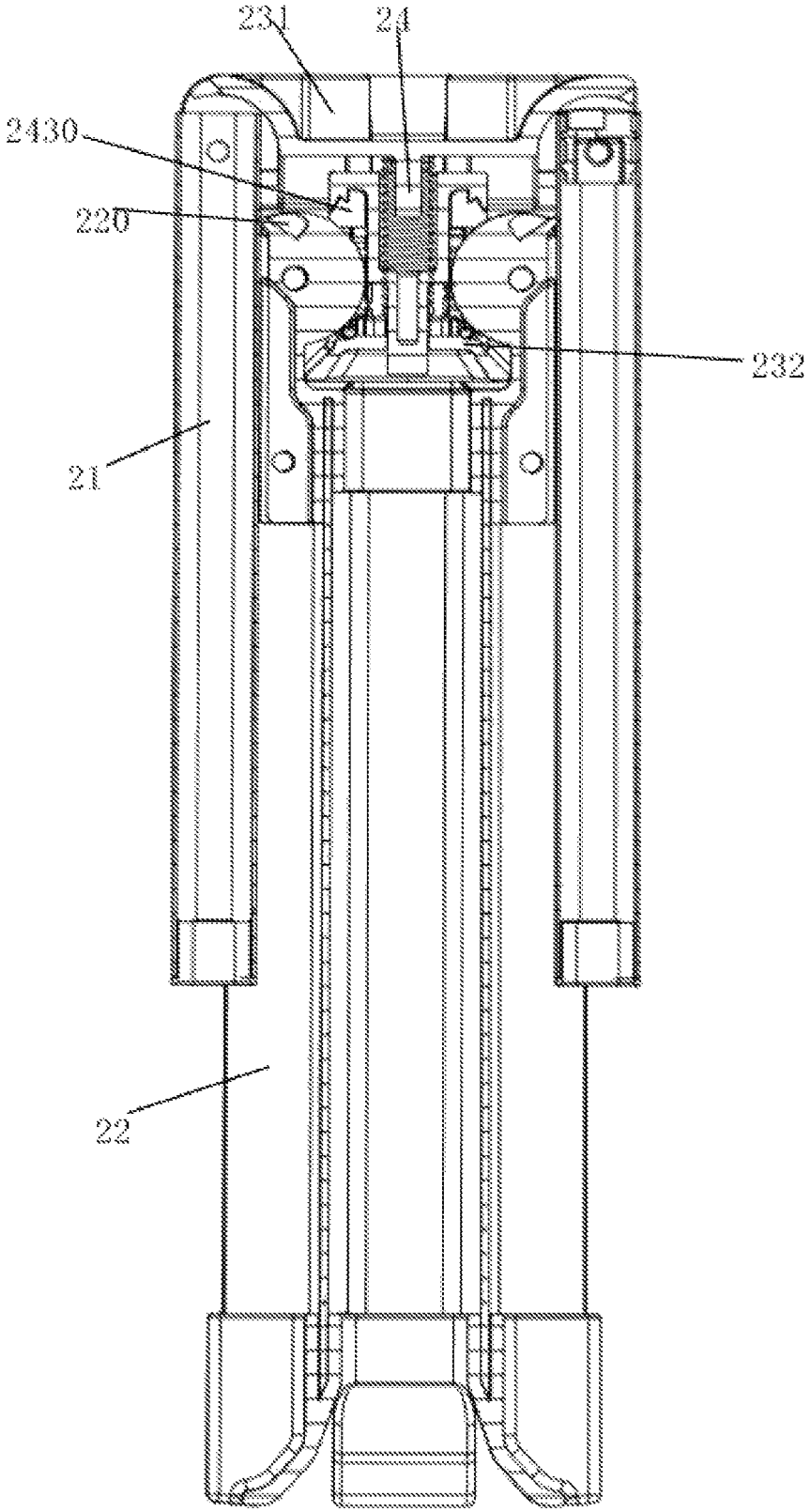
FIG. 9 is a cross-sectional view of a retracted state of a height-adjustable folding chair according to another embodiment of the present disclosure.

When the folding chair 2 is in a retracted state (as shown in FIG. 9), all the legs 22 and arms 21 extend towards a bottom of the base 20, with the positioning slots 220 of the legs 22 opens back to the inner cavity 200. When the folding chair 2 is required to be unfolded, the legs 22 are rotated upward by directly separating the legs 22 by hand, the first locking block 243 moves downward, and the leg unlock button 241 is pushed by the first spring 242 while moving downward to protrude from the lower receiving portion 232.

Figure 7:
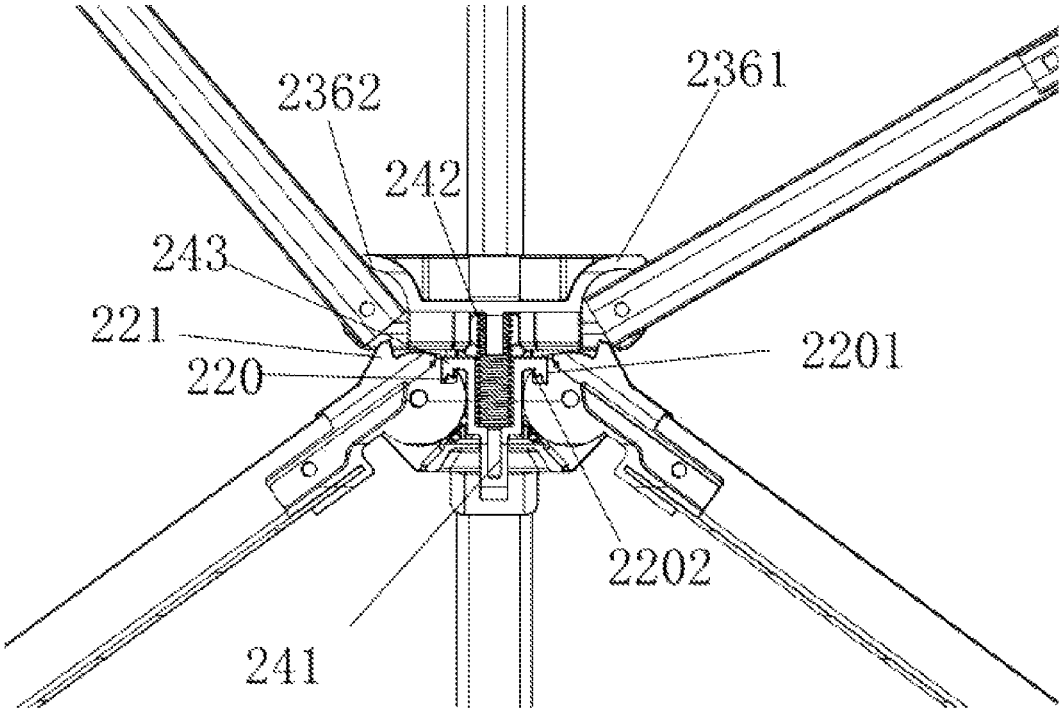
FIG. 7 is a partial cross-sectional view of a first unfolded state of a height-adjustable folding chair according to another embodiment of the present disclosure.

When the legs 22 rotate to the position shown in FIG. 7, the positioning slots 220 rotate to a position facing upward, and each positioning block 2202 enters a corresponding locking slot 2430, while the corresponding positioning tongue 2201 snaps into an outer wall of the first locking block 243. The legs 22 are positioned in this case and will not continue to rotate, being in a second unfolded state with the height of the base 20 from the ground lower.

Figure 8:
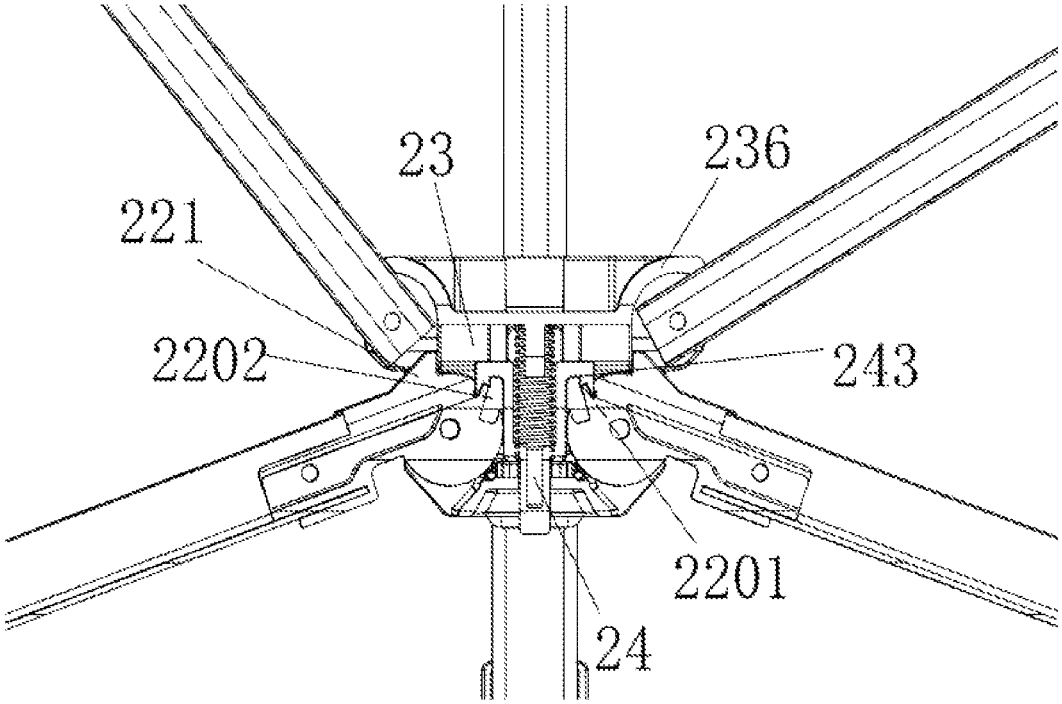
FIG. 8 is a partial cross-sectional view of a second unfolded state of a height-adjustable folding chair according to another embodiment of the present disclosure.

When the folding chair 2 is required to be lowered, the leg unlock button 241 may be pressed to move the first locking block 243 upward, such that the positioning tongue 2201 and positioning block 2202 are free from the locking slot 2430, and then the legs 22 can continue to rotate upward to the position as shown in FIG. 8. In this case, when the leg unlock button 241 is released, the leg unlock button 241 is pushed by the first spring 242 while moving downward to protrude further from the lower receiving portion 232, and the positioning tongue 2201 snaps into an inner wall of the locking slot 2430. A side of each leg 22 back from the inner cavity 200 is arranged with a limit block 221, which abuts against the support 23. In this way, the leg 22 is positioned, and the folding chair 2 is in a second unfolded state with the height of the base 20 from the ground less than the height of the base 20 from the ground in the second unfolded state.

When the folding chair 2 is required to be retracted, the leg unlock button 241 may be pressed such that the legs 22 are rotated downward to a retracted state under an un-positioning condition.

In some embodiments, the upper receiving portion 231 is arranged with a motion stop 236 to limit an upward rotation angle of the arms 21. Each arm includes a front arm 213 and a rear arm 214, with the maximum length of the front arm 213 being less than the maximum length of the rear arm 214. The motion stop 236 includes a front stop 2361 and a rear stop 2362, with the front stop 2361 limiting the angle at which the front arm 213 can rotate less than the rear stop 2362 limiting the angle at which the rear arm 214 can rotate. Due to the presence of the motion stop 236, the angle of upward rotation of the arm 21 is limited. When the multiple retractable arms 21 are extended, the tension of a seat fabric 3 sleeved on the arms 21 may be used to prevent the arms 21 from sagging. When the folding chair 2 is required to be put away, the leg unlock button may be pressed to make the multiple legs 22 rotate downward, while shortening the multiple arms 21, such that the multiple arms 21 naturally sag to put away the folding chair 2.

The height-adjustable folding chair provided by the present disclosure includes a base, multiple retractable arms connected to the base and multiple legs connected to the base; the base includes a support enclosing an inner cavity and a locking assembly arranged in the inner cavity; the support includes an upper receiving portion connected to the arms and a lower receiving portion connected to the legs; the locking assembly includes a leg unlock button inserted in the inner cavity and slidable relative to the support, a first spring arranged in the leg unlock button, and a first locking block connected to the leg unlock button. The first locking block defines locking slots each with a downward opening; an end of each leg connected to the lower receiving portion defines a positioning slot and is arranged with a positioning tongue protruding from an edge of the positioning slot and a positioning block protruding upward from a bottom of the positioning slot and matched with a corresponding locking slot. The positioning tongue abuts against an outer wall of the first locking block when the legs are unfolded to a first unfolded state relative to the base; and the positioning tongue abuts against the inner wall of the locking slot when the legs are unfolded to a second unfolded state relative to the base. By virtue of the locking slot of the first locking block cooperating with the positioning slot, the positioning tongue, and the positioning block of the leg, the folding chair can have two different unfolding states, thereby improving the use experience.

The above embodiments are only intended to illustrate the technical solution of the present disclosure, not to limit the same; despite the detailed description of the present disclosure with reference to the preceding embodiments, those skilled in the art should understand that it is still possible to modify the technical solutions recorded in the preceding embodiments, or to replace some or all of them with equivalent technical features; and these modifications or replacements do not make the essence of the corresponding technical solutions out of the scope of the technical solutions of the embodiments of the present disclosure.

What is claimed is:

1. A height-adjustable folding chair, comprising a base, a plurality of retractable arms connected to the base, and a plurality of legs connected to the base; wherein the base comprises a support enclosing an inner cavity and a locking assembly arranged in the inner cavity; the support comprises an upper receiving portion connected to the plurality of retractable arms and a lower receiving portion connected to the plurality of legs; the locking assembly comprises a leg unlock button inserted in the inner cavity and slidable relative to the support, a first spring arranged in the leg unlock button, and a first locking block connected to the leg unlock button; the first locking block comprises a plurality of protruding portions protruding radially outward from a center axis; an end opening is partially formed on an end of each protruding portion; the first locking block defines a plurality of locking slots each with a downward opening; an end of each leg connected to the lower receiving portion defines a positioning slot and is arranged with a positioning tongue protruding from an edge of the positioning slot and a positioning block protruding upward from a bottom of the positioning slot and matched with a corresponding one of the plurality of locking slots;

the positioning tongue abuts against an outer wall of the end of each protruding portion in condition of the leg being unfolded to a first unfolded state relative to the base; and the positioning tongue enters the corresponding locking slot through the end opening and abuts against an inner wall of the end of each protruding portion, in condition of the leg being unfolded to a second unfolded state relative to the base.

2. The height-adjustable folding chair according to claim 1, wherein an end of each leg away from the base is arranged on a support surface; a distance from the base to the support surface in the first unfolded state is greater than a distance from the base to the support surface in the second unfolded state.

3. The height-adjustable folding chair according to claim 1, wherein the end of each leg connected to the lower receiving portion is arranged with a plurality of leg tooth portions, and the plurality of leg tooth portions of the plurality of legs are engaged such that a motion of each leg is capable of causing the rest of the plurality of legs to move.

4. The height-adjustable folding chair according to claim 3, wherein the end of each leg connected to the lower receiving portion is further arranged with a leg arc, and the plurality of leg tooth portions are distributed on both sides of the leg arc; each tooth of the plurality of leg tooth portions is elliptically chamfered.

5. The height-adjustable folding chair according to claim 1, wherein the upper receiving portion is arranged with a stop to limit a downward rotation angle of the plurality of retractable arms.

6. The height-adjustable folding chair according to claim 5, wherein the locking assembly further comprises an arm unlock button inserted in the inner cavity and slidable relative to the support, a second spring sleeved in the arm unlock button, and a second locking block connected to the arm unlock button; an end of each retractable arm connected to the upper receiving portion defines an arm positioning slot; the second locking block is stuck in the arm positioning slot and is positioned by an elasticity of the second spring in condition of the retractable arm being unfolded related to the base.

7. The height-adjustable folding chair according to claim 1, wherein each leg defines a receiving slot; in condition of the folding chair being retracted, each retractable arm is housed in a corresponding leg.

8. The height-adjustable folding chair according to claim 1, wherein the upper receiving portion is arranged with a motion stop to limit an upward rotation angle of the plurality of arms.

9. The height-adjustable folding chair according to claim 8, wherein each arm comprises a front arm and a rear arm, with a maximum length of the front arm being less than a maximum length of the rear arm.

10. The height-adjustable folding chair according to claim 9, wherein the motion stop comprises a front stop and a rear stop, wherein the front stop limits the upward rotation angle to a greater degree than the rear stop limits the upward rotation angle.

11. The height-adjustable folding chair according to claim 1, wherein the first locking block is an integrated structure.

12. The height-adjustable folding chair according to claim 1, wherein the first locking block is in a cross shape.

* * * * *